US009757616B2

(12) United States Patent
Kwan tai

(10) Patent No.: US 9,757,616 B2
(45) Date of Patent: Sep. 12, 2017

(54) ORAL FUNCTION DEVICE

(71) Applicant: Leung Kwan tai, Hong Kong (HK)

(72) Inventor: Leung Kwan tai, Hong Kong (HK)

( * ) Notice: Subject to any disclaimer, the term of this patent is extended or adjusted under 35 U.S.C. 154(b) by 0 days.

(21) Appl. No.: 14/258,012

(22) Filed: Apr. 22, 2014

(65) Prior Publication Data

US 2016/0045783 A1 Feb. 18, 2016

Related U.S. Application Data

(60) Provisional application No. 61/814,743, filed on Apr. 22, 2013.

(51) Int. Cl.
*A63B 21/00* (2006.01)
*A63B 23/03* (2006.01)

(52) U.S. Cl.
CPC ..... *A63B 23/032* (2013.01); *A63B 21/00185* (2013.01); *A63B 21/4035* (2015.10)

(58) Field of Classification Search
CPC ..... A63B 23/032; A61H 2205/026; A61J 17/00–17/02
See application file for complete search history.

(56) References Cited

U.S. PATENT DOCUMENTS 4,867,159 A * 9/1989 Fulton ..... A61J 17/00 606/236
5,211,656 A * 5/1993 Maddocks ..... A61J 17/008 606/234
5,366,481 A * 11/1994 Zade ..... A61J 17/00 606/234
5,908,440 A * 6/1999 McCloskey ..... A61J 17/00 606/234
2013/0102997 A1* 4/2013 Abbassmovahedi . A61J 7/0053 604/514

* cited by examiner

*Primary Examiner* — Sundhara Ganesan
*Assistant Examiner* — Jennifer M Deichl
(74) *Attorney, Agent, or Firm* — Jones Day

(57) ABSTRACT

An oral function device. The oral function device may include an elongated hollow handle with a flange disposed around a first opening of the elongated hollow handle. The oral function device may include an elongated chew piece fixated by the end plug to prevent the elongated chew piece from falling off the elongated hollow handle. The elongated chew piece may rotate freely inside the elongated hollow handle.

4 Claims, 6 Drawing Sheets

ORAL FUNCTION DEVICE

This application claims priority to U.S. Provisional Application 61/814,743 filed on Apr. 22, 2013, the entire disclosure of which is incorporated by reference.

BACKGROUND OF THE INVENTION

Field of the Invention

The present invention is an oral device. More specifically, the present invention is an oral function device.

Description of the Related Art

People such as children or adults because of developmental problems (e.g., cerebral palsy, Down's syndrome) or an acquired injury (e.g., a head injury or a stroke) may experience a loss of their oral-motor function (e.g., failure or loss of previous abilities to chew food or eat, failure or loss of abilities to swallow, or failure or loss of abilities to speak).

The ability to control the lower jaw is the foundation of many human's most significant abilities (e.g., feeding, speech, swallowing and respiration). As babies start to develop their feeding skill from sucking milk, to suckle, and then to munch food at the age of six to seven months, and then start to develop some vertical jaw movement and biting at the age of twelve months, and start to develop some lateral jaw movement at the age of eighteen to twenty-four months and by the age of thirty-six months, most children may develop mature rotary jaw movement and manage most solid food easily. From a developmental point of view, some children have failed to achieve these developmental milestones and feeding skills because of inadequate basic foundation oral-motor skills (e.g., weak mastication muscle strength and inadequate lower jaw's mobility and stability).

The present invention may solve the aforementioned problems of delay in mastication such as inadequate strength, range of motion of lower jaw and lack of appropriate experience of lower jaw in different directions of movement.

BRIEF SUMMARY OF THE INVENTION

The present invention is an oral device. More specifically, the present invention is an oral function device.

The oral function device is to solve problems associated with a delay in mastication such as inadequate strength, range of motion of lower jaw and lack of appropriate experience of lower jaw in different directions of movement. The oral function device is made of non-nutritive and non-toxic resilient tubing. The tubing is placed under the crushing molar teeth in either a sagittal plane or a coronal plane according to the direction of lower jaw movement training. Therapists instruct client to chew on this tube in multistep, progressive and rhythmic chewing in an up and down, left and right or front and back manner.

The oral function device includes an elongated hollow handle having a first end and a second end and a first opening and a second opening, the first opening is disposed on the first end of the elongated hollow handle and the second opening is disposed on the second end of the elongated hollow handle, the elongated hollow handle includes a flange disposed around the first opening of the elongated hollow handle and an elongated chew piece removably inserted into the first opening of the elongated hollow handle, the elongated chew piece rotates freely inside the elongated hollow handle. The oral function device also includes an end plug inserted into the second opening of the elongated hollow handle, the end plug include a base, an extension and a protruding attachment tab, the extension is coupled to a center of the base, the extension has a top curved prong and a bottom curved prong, the top curved prong includes a protruding attachment tab, the top curved prong and the bottom curved prong are made of pliable material, the protruding attachment tab corresponds with the aperture disposed adjacent to the second end of the elongated hollow handle, the top curved prong and the bottom curved prong bend while inserted into the second end of the elongated hollow handle, the protruding attachment tab securely snaps into place within the aperture disposed adjacent to the second end of the elongated hollow handle and the protruding attachment tab is depressed to release the end plug from the elongated hollow handle; and It is an object of the present invention to provide an oral function device that improves the dissociation of a user's jaw with multidimensional exercises for dynamic movements.

It is an object of the present invention to provide an oral function device that offers three directions of lower jaw training and a combination of either up and down and left and right of lower jaw training or up and down and front and back of lower jaw training.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention however; the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
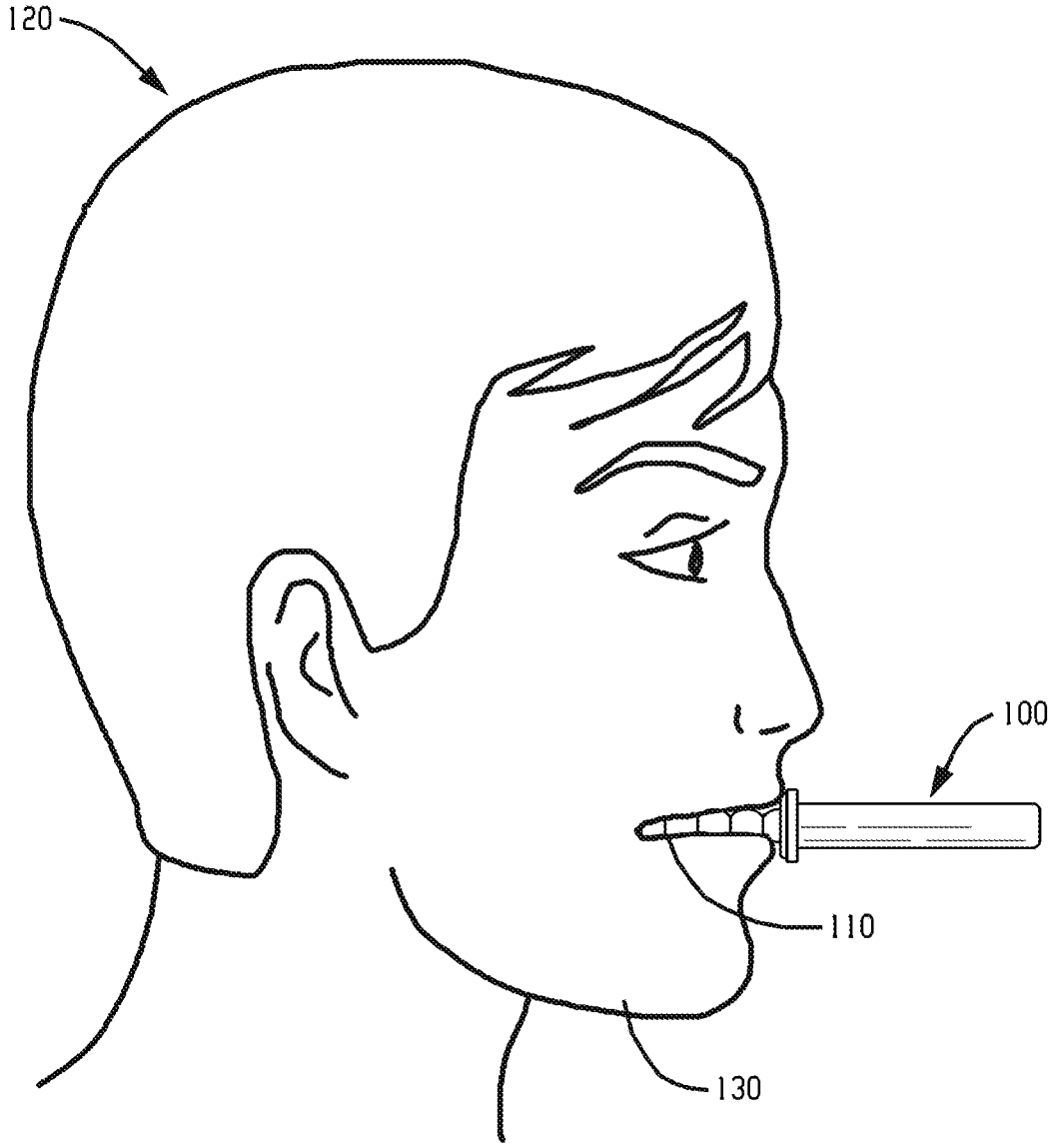
FIG. 1 illustrates an environmental view of an oral function device, in accordance with one embodiment of the present invention.

FIG. 1 illustrates an environmental view of an oral function device 100, in accordance with one embodiment of the present invention.

The oral function device 100 may be inserted into a user's mouth 110 as is illustrated in FIG. 1. The user 120 may be a child, an adult or other suitable user. The user 120 may perform a plurality of multidimensional chewing exercises with the oral function device 100 which may improve dissociation of a user's jaw 130. The oral function device 100 may solve problems associated with a delay in the user's mastication such as inadequate strength, range of motion of the lower jaw and lack of appropriate experience of the lower jaw in different directions of movement.

Figure 2:
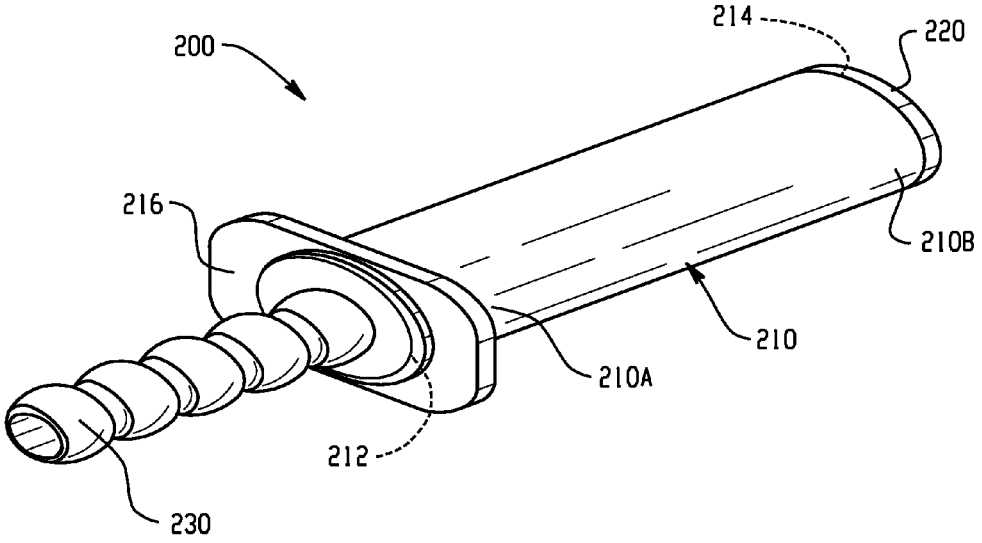
FIG. 2 illustrates a side view of an oral function device, in accordance with one embodiment of the present invention.

FIG. 2 illustrates a side view of an oral function device 200, in accordance with one embodiment of the present invention.

The oral function device 200 may include an elongated hollow handle 210, an end plug 220 and an elongated chew piece 230. The elongated hollow handle 210 may have a first end 210A and a second end 210B. The elongated hollow handle 210 may include a first opening 212 and a second opening 214. The first opening 212 may be disposed on the first end 210A of the elongated hollow handle 210. The second opening 214 may be disposed on the second end 210B of the elongated hollow handle 210. The elongated hollow handle 210 may also include a flange 216 disposed around the first opening 212 of the elongated hollow handle 210. The flange 216 may be designed in front of the elongated hollow handle 210 to prevent child users from putting the elongated chew piece 230 too far into their mouth. The end plug 220 may be inserted into the second opening 212 of the elongated hollow handle 210. The elongated chew piece 230 may be protected by the flange 216 while the user is grasping the elongated hollow handle 210. The elongated chew piece 230 may be removably inserted into the first opening 212 of the elongated hollow handle 210. The term removably inserted may be defined as inserting the elongated chew piece 230 into the first opening 212 of the elongated hollow handle 210 while having the capability of removing the elongated chew piece 230 from the first opening 212 of the elongated hollow handle 210. The elongated chew piece 230 may be fixated by the end plug 220 to prevent the elongated chew piece 230 from falling off the elongated hollow handle 210. The elongated chew piece 230 may be a piece of non-nutritive and non-toxic resilient tubing with a wave shaped appearance. The elongated chew piece 230 may rotate freely inside the elongated hollow handle 210.

Figure 3:
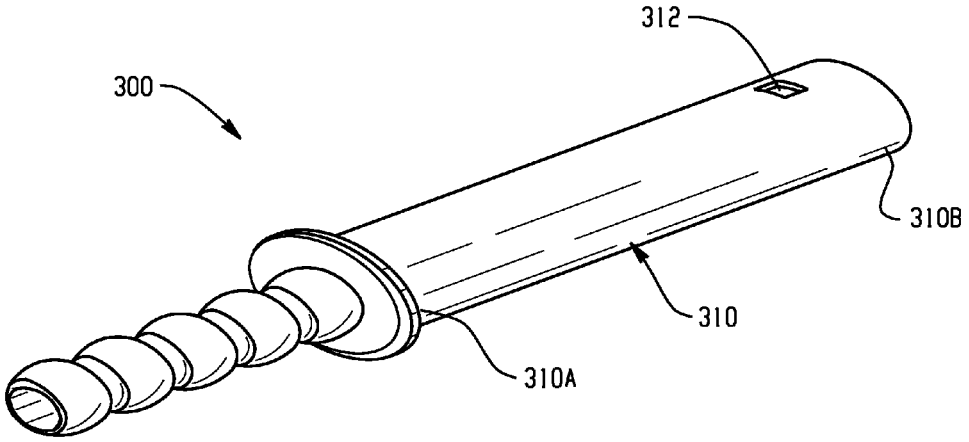
FIG. 3 illustrates a side view of an oral function device without an end plug, in accordance with one embodiment of the present invention.

FIG. 3 illustrates a side view of an oral function device 300 without an end plug, in accordance with one embodiment of the present invention.

The oral function device 300 may include an elongated hollow handle 310. The elongated hollow handle 310 may have a first end 310A and a second end 310B. The elongated hollow handle 310 may include an aperture 312 disposed adjacent to the second end 310B of the elongated hollow handle 310.

Figure 4:
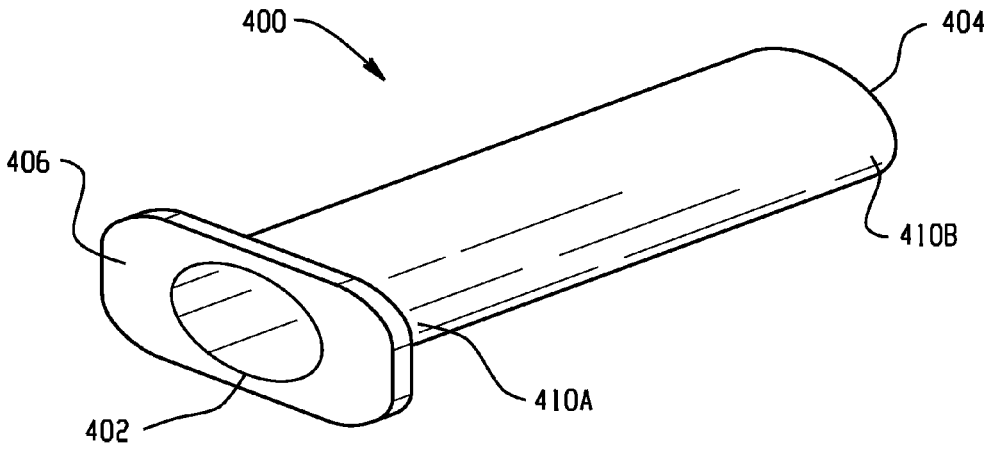
FIG. 4 illustrates a side view of an elongated hollow handle, in accordance with one embodiment of the present invention.

FIG. 4 illustrates a side view of an elongated hollow handle 400, in accordance with one embodiment of the present invention.

The elongated hollow handle 400 may have a first end 400A and a second end 400B. The elongated hollow handle 400 may include a first opening 402 and a second opening 404. The first opening 402 may be disposed on the first end 400A of the elongated hollow handle 400. The second opening 404 may be disposed on the second end 400B of the elongated hollow handle 400. The elongated hollow handle 400 may also include a flange 406 disposed around the first opening 402 of the elongated hollow handle 400. The flange 406 may support a user's grasp on the oral function device 400 by allowing the user's fingers to push against the flange 406 while the user is grasping the oral function device 400.

Figure 5:
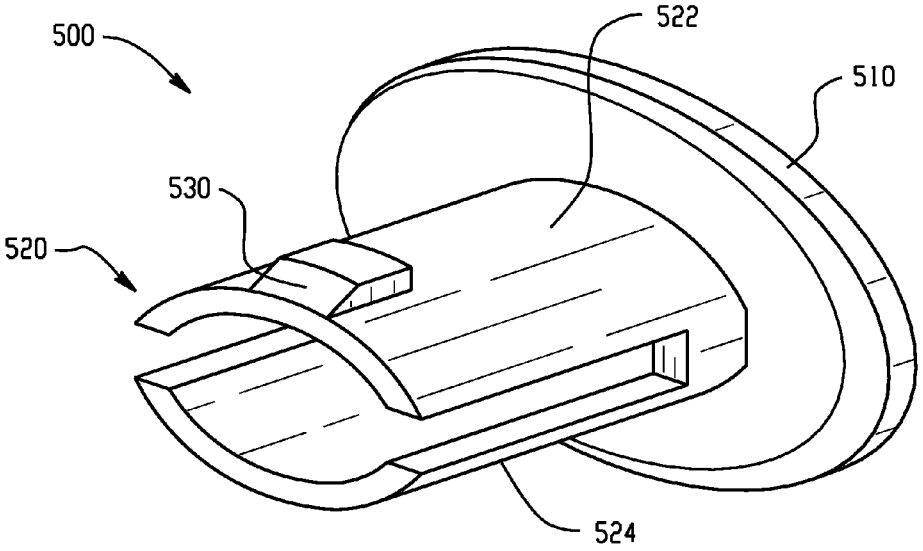
FIG. 5 illustrates a side view of an end plug, in accordance with one embodiment of the present invention.

FIG. 5 illustrates a side view of an end plug 500, in accordance with one embodiment of the present invention.

The end plug 500 may include a base 510, an extension 520 and a protruding attachment tab 530. The base 510 may have a planar circular shape 510A or other suitable planar shape. The extension 520 may be coupled to a center of the base 510. The extension 520 may have a top curved prong 522 and a bottom curved prong 524. The top curved prong 522 and the bottom curved prong 524 may be made of pliable material. The top curved prong 522 may include a protruding attachment tab 530. The protruding attachment tab 530 may correspond with the aperture (FIG. 3, 312) disposed adjacent to the second end (FIG. 3, 310B) of the elongated hollow handle (FIG. 3, 310). The top curved prong 522 and the bottom curved prong 524 may bend while inserted into the second end (FIG. 3, 310B) of the elongated hollow handle (FIG. 3, 310). The protruding attachment tab 530 may securely snap into place within the aperture (FIG. 3, 312) disposed adjacent to the second end (FIG. 3, 310B) of the elongated hollow handle (FIG. 3, 310). The protruding attachment tab 530 may be depressed to release the end plug 500 from the elongated hollow handle (FIG. 3, 310).

Figure 6:
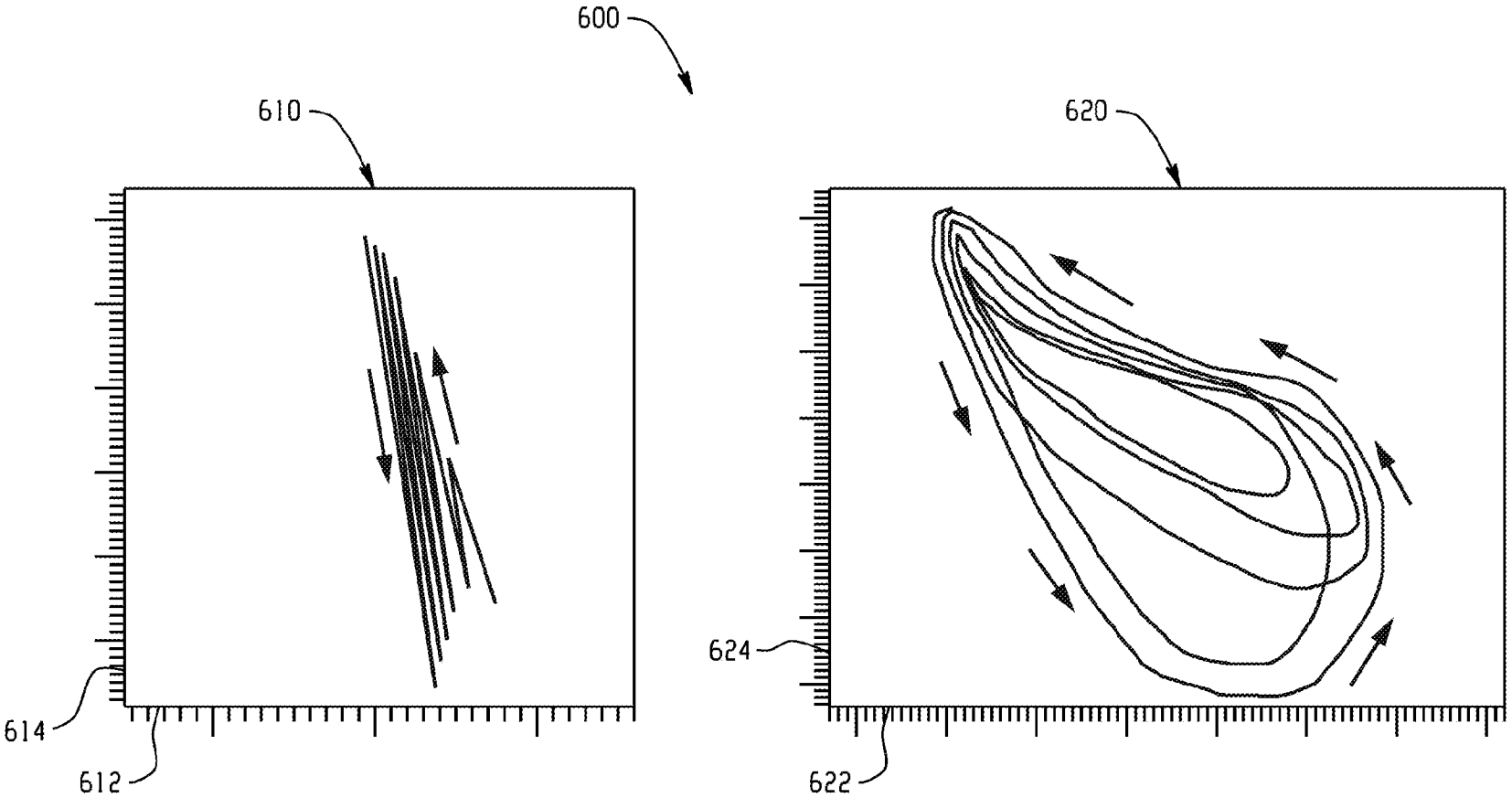
FIG. 6 illustrates a pair of graphs representing proposed action of a user's jaw during two stages of chewing development, in accordance with one embodiment of the present invention.

FIG. 6 illustrates a pair of graphs 600 representing proposed action of a user's jaw during two stages of chewing development, in accordance with one embodiment of the present invention.

The pair of graphs 600 includes a first graph 610 and a second graph 620. The first graph 610 may illustrate a plurality of predicted motion paths during early chewing. The first graph 610 may have an x-axis 612 and a y-axis 614. The x-axis 612 may represent horizontal side-to-side jaw motion during chewing. The y-axis 614 may represent vertical up-and-down jaw motion during chewing. The first graph 610 may illustrate a strict vertical component of the jaw tracing, which is characteristic of early chewing. The second graph 620 may illustrate a plurality of predicted motion paths during mature chewing. The second graph 620 may have an x-axis 622 and a y-axis 624. The x-axis 622 may represent horizontal side-to-side jaw motion during chewing. The y-axis 624 may represent vertical up-and-down jaw motion during chewing. The second graph 620 may illustrate a consistent rotary motion, which is characteristic of mature chewing.

The oral function device may be made of three parts, an elongated hollow handle, an end plug and an elongated chew piece. The elongated chew piece may have a wave shaped appearance tube. The elongated chew piece may be inserted into the hollow cylindrical handle. The elongated chew piece may rotate freely inside the hollow cylindrical handle. The end plug may be fixated to the elongated chew piece and prevent it from falling off of the elongated hollow handle. A flange may be designed in front of the elongated hollow handle to prevent child users from putting the elongated chew piece too far into their mouth.

Use of the oral function device is straightforward. For the combination of training the lower jaw in up and down and left and right directions, a user may put the oral function device in a sagittal plane. The oral function device may be placed in a crushing molar in a sagittal plane. When the lower jaw may be closed or is elevated, the elongated chew piece may give a resistive force to the mastication muscles to help to strength the mastication muscles. The user's teeth may depress on the elongated chew piece which may rotate freely, and that rotating elongated chew piece may provide a sheering surface or unstable surface that may deviate the lower jaw from exclusive vertical up and down movement and encourage the jaw moving laterally (i.e., side to side movement). The combination of training lower jaws in up and down, and front and back directions, may include putting the oral function device in a coronal plane. The oral function device may be placed under a crushing molar in the coronal plane. When the jaw closes, it may give a resistant force to the mastication muscle that elevates the lower jaw (i.e. closing the jaw), to strengthen matriculations muscles in an up and down direction. The user's teeth may depress on the elongated chew piece that may rotate freely and provide a sheering surface or unstable surface which may deviate the lower jaw from exclusive vertical up and down movement and encourage the lower jaw moving in a front and back direction.

The oral function device may improve the jaw s movement in three dimensions (i.e., up and down, left and right, and front and back). As explained in the following research, the lower jaw is travelling in a tear-drop shape as age matured. Therefore, the oral function device when placed in sagittal and coronal plane, may help improving the jaw movement in a three dimensional plane (i.e. up and down, left and right, front and back). And the oral function device may facilitate the natural developmental changes of movement of the lower jaw.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. An oral function device, comprising:

an elongated hollow handle having a first end and a second end and a first opening and a second opening, the first opening is disposed on the first end of the elongated hollow handle and the second opening is disposed on the second end of the elongated hollow handle, the elongated hollow handle includes a flange disposed around the first opening of the elongated hollow handle;

an end plug comprising a single piece that is inserted into the second opening of the elongated hollow handle and covers an entirety of the second opening, the end plug including a base, an extension and a protruding attachment tab, the extension is coupled to a center of the base, the extension has a top curved prong and a bottom curved prong, the top curved prong includes a protruding attachment tab, the top curved prong and the bottom curved prong are made of pliable material, the protruding attachment tab corresponds with the aperture disposed adjacent to the second end of the elongated hollow handle, the top curved prong and the bottom curved prong bend while inserted into the second end of the elongated hollow handle, the protruding attachment tab securely snaps into place within the aperture disposed adjacent to the second end of the elongated hollow handle and the protruding attachment tab is depressed to release the end plug from the elongated hollow handle; and an elongated chew piece oriented in an opposite direction along a same plane as the elongated hollow piece, removably inserted into the first opening of the elongated hollow handle, the elongated chew piece rotates freely inside the elongated hollow handle, the elongated chew piece being fixated by the end plug to prevent the elongated chew piece from falling off the elongated hollow handle.

2. The oral function device according to claim 1, wherein the flange is designed in front of the elongated hollow handle to prevent a child user from putting the elongated chew piece too far into their mouth.

3. The oral function device according to claim 1, wherein the elongated chew piece is a piece of non-nutritive and non-toxic resilient tubing with a wave shaped appearance.

4. The oral function device according to claim 1, wherein the user may perform a plurality of multidimensional chewing exercises with the oral function device to improve dissociation of the user's jaw.

* * * * *